US009543701B2

(12) United States Patent
Garske

(10) Patent No.: US 9,543,701 B2
(45) Date of Patent: Jan. 10, 2017

(54) SURFACE-OPTIMISED PLUG-IN CONNECTOR

(71) Applicant: Harting Electric GmbH & Co. KG, Espelkamp (DE)

(72) Inventor: Stefan Garske, Bad Essen (DE)

(73) Assignee: HARTING ELECTRIC GMBH & CO. KG, Espelkamp (DE)

( * ) Notice: Subject to any disclaimer, the term of this patent is extended or adjusted under 35 U.S.C. 154(b) by 0 days.

(21) Appl. No.: 14/773,616

(22) PCT Filed: Mar. 5, 2014

(86) PCT No.: PCT/DE2014/100078
§ 371 (c)(1),
(2) Date: Sep. 8, 2015

(87) PCT Pub. No.: WO2014/135156
PCT Pub. Date: Sep. 12, 2014

(65) Prior Publication Data

US 2016/0043503 A1 Feb. 11, 2016

(30) Foreign Application Priority Data

Mar. 7, 2013 (DE) ..... 20 2013 100 979

(51) Int. Cl.

| | |
|---|---|
| ***H01R 13/627*** | (2006.01) |
| ***H01R 13/639*** | (2006.01) |
| ***H01R 13/52*** | (2006.01) |
| *H01R 13/622* | (2006.01) |

(52) U.S. Cl.
CPC ..... *H01R 13/639* (2013.01); *H01R 13/5219* (2013.01); *H01R 13/622* (2013.01)

(58) Field of Classification Search
CPC .. H01R 13/639; H01R 13/5219; H01R 13/622
USPC ..... 439/359, 271, 594
See application file for complete search history.

(56) References Cited

U.S. PATENT DOCUMENTS

| | | | | |
|---|---|---|---|---|
| 7,311,555 | B1 | 12/2007 | Burris et al. | |
| 9,130,304 | B2 | 9/2015 | Mehnert et al. | |
| 2005/0176296 | A1 | 8/2005 | Montena | |
| 2007/0134967 | A1* | 6/2007 | Montena | H01R 9/05 439/277 |

FOREIGN PATENT DOCUMENTS

| | | |
|---|---|---|
| DE | 2545179 | 4/1977 |
| DE | 102009003016 | 11/2010 |
| EP | 0565289 | 10/1993 |
| GB | 1518406 | 7/1978 |
| GB | 2054079 | 8/1981 |
| GB | 2244388 | 11/1991 |

* cited by examiner

*Primary Examiner* — Javaid Nasri
(74) *Attorney, Agent, or Firm* — Jacobson Holman, PLLC.

(57) ABSTRACT

A plug-in connector comprising a plug-in connector housing and a locking element for mechanically connecting the plug-in connector housing to a counterpart plug-in connector. The locking element is externally accessible on the plug-in connector housing. Protective elements, which protect the transition regions, are provided at transition regions between the plug-in connector housing and the locking element.

12 Claims, 2 Drawing Sheets

SURFACE-OPTIMISED PLUG-IN CONNECTOR

Figure 1:
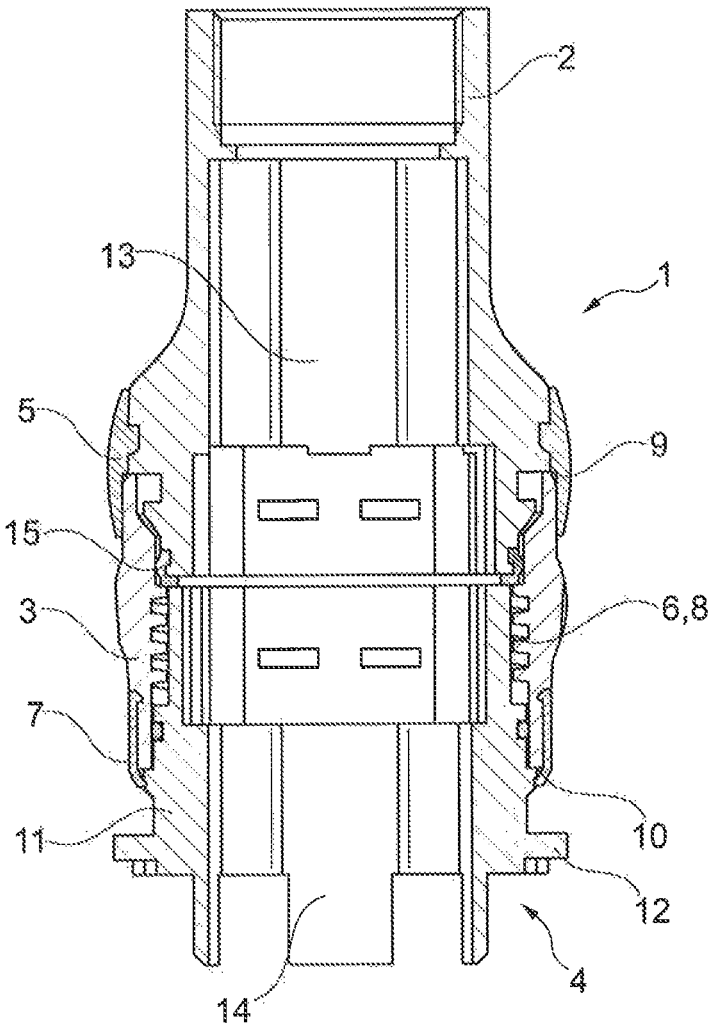

The invention relates to a plug-in connector comprising a plug-in connector housing and a locking means (i.e., a locking element).

Plug-in connectors of this type are required for establishing connections for signal and/or power transmission, Connections of for example electrical, pneumatic or optical signals have to be protected from environmental influences. Plug-in connectors of this type ensure reliable contacting of the conductor to be contacted. At the same time, plug-in connectors of this type seal the contacted conductor against said environmental influences.

DE2545179A1 discloses a round plug-in connector comprising a hollow, substantially cylindrical housing and a coupling ring provided on the housing. By means of the coupling ring, the round plug-in connector can be mechanically fixed to a counterpart plug.

To seal contact elements which are received in the round plug-in connector, it has a plurality of sealing elements which are received in the round plug-in connector. Among other things, this brings about sealing against environmental influences at the rear-face cable outlet.

A further seal, which prevents environmental influences from penetrating into the plug-in connector, is provided between the housing and the coupling ring.

A number of plug-in connectors comprising means for sealing against environmental influences are further known in the art. These means are applied between the individual components of the plug-in connector. This provides a sealing effect.

A drawback of the plug-in connectors and coupling elements known in the art is that they are merely configured against the penetration of environmental influences. They are configured to protect the internal contact elements against environmental influences.

None of the known plug-in connectors are configured against the deposition of soiling, dirt and other environmental influences on the outside of the plug-in connector. This may be important if a plug-in connector of this type is used for example in food processing environments.

High cleanliness and hygiene standards are required in food processing. It is obligatory and necessary for all articles, machines and work devices used in these fields to be cleaned daily.

Food particles and other dirt particles can stick to edges, as well as gaps, slits and cracks of articles. In for example meat-processing businesses, such as butcheries, which process animals such as pigs, cattle, horses or poultry into food products, this is frequently the case.

A mixture of very small meat particles, offal parts, blood and bone splinters forms a strongly adhesive mass, which can easily stick on and is difficult to remove. This mixture is very hazardous in terms of bacteria.

Especially under the influence of ambient air, the mass can develop very strong adhesion. Aside from the aforementioned bacterial hazard, the unpleasant odour of a mixture of this type also cannot be ignored if it cannot be removed promptly.

Surfaces to which said mixture of organic material sticks easily thus constitute a hazard for example for employees and products in food-processing businesses.

Easy-to-clean surfaces and shapes are advantageous in this context. In addition, articles having optimised surfaces help to keep the cleaning outlay limited.

The object of the invention is to form a plug-in connector in such a way that deposition and sticking of particles on the plug-in connector and in the transition regions of plug-in connector parts are not possible. This should prevent soiling of the plug-in connector and provide simple cleaning.

The invention consists of a plug-in connector, preferably a round plug-in connector. The plug-in connector basically consists of a plug-in connector housing for receiving contact means. Depending on the type, these contact means are held in an insulating receiver which is inserted into the plug-in connector housing.

The more detailed configuration of the contact means and the arrangement thereof in the plug-in connector are not discussed further here. A number of plug-in connectors, contact means and insulating bodies are known in the art. All of these may be used equivalently in the presently disclosed plug-in connector.

On the proposed plug-in connector, a locking means, by means of which the plug-in connector can be locked to a counterpart plug-in connector, is provided on the plug-in connector housing. This may be a sliding sleeve for push-pull plug-in connectors, or else a coupling ring or screw ring for round plug-in connectors.

The locking means should be configured in accordance with the type of plug-in connector lock, and can be transferred to a number of different locks. The screw lock shown in the present invention for a round plug-in connector should be treated as an example and not as limiting the invention.

According to the invention, the plug-in connector has a protective element which covers the transition region between the plug-in connector housing and the locking means. This prevents dirt from accumulating in this sensitive region.

At the transition regions between two components, in this case the plug-in connector housing and the locking means, there will necessarily be slits. These are covered by the protective element.

In a preferred embodiment, the protective element, which consists of a resilient plastics material, is fixed to one of the two components and is positioned tightly on the second of the two components. On the one hand, this can prevent the penetration of dirt. On the other hand, movement of the locking means relative to the plug-in connector housing is made possible.

The fixing of the protective element to one of the components—the plug-in connector housing or the locking means—may for example be formed in a single piece by 2K injection moulding. However, other options such as gluing are also conceivable.

It is expedient for all of the components of the plug-in connector, as well as the transitions from the protective element, to be formed with smooth edges to prevent accumulation of dirt.

EMBODIMENT

Figure 2:
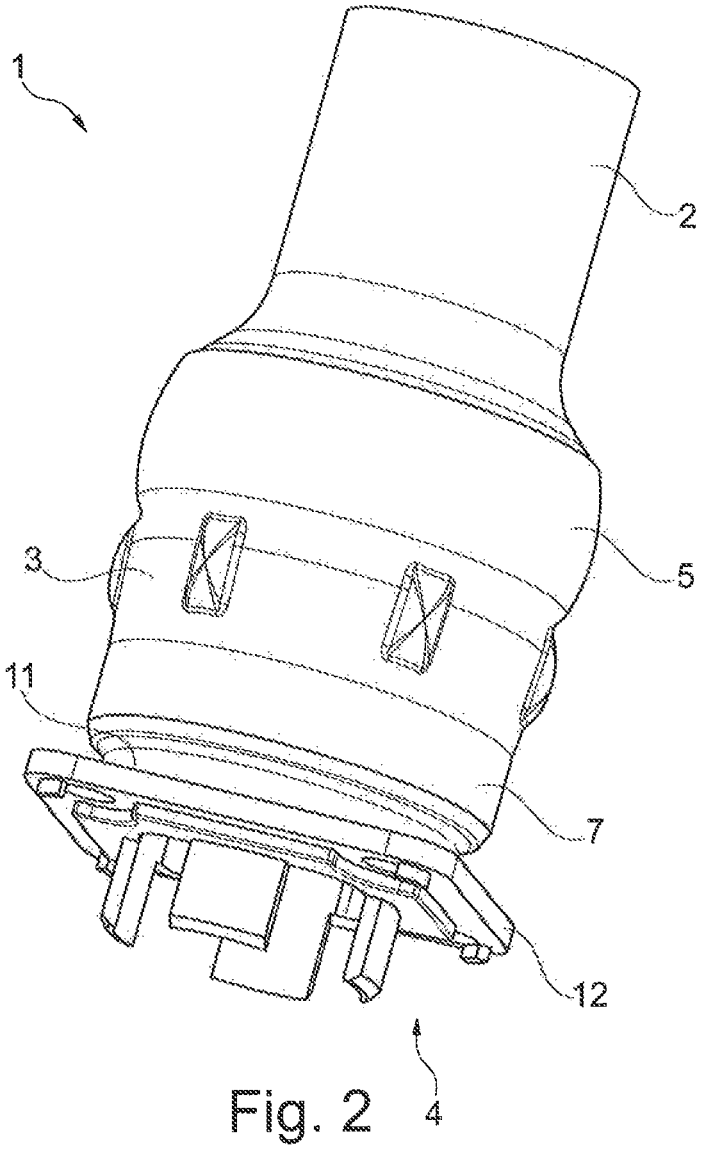

An embodiment of the invention is shown in the drawings and described in greater detail in the following. In the drawings:

FIG. 1 is a sectional drawing of a plug-in connector according to the invention which is connected to a counterpart plug-in connector, and FIG. 2 is non-sectional drawing of a plug-in connector according to the invention along with a connected counterpart plug-in connector.

FIG. 1 is a sectional view of a plug-in connector 1 according to the invention which is connected and locked to a counterpart plug-in connector 4. A plug-in connector housing 2 can be seen, which forms the plug-in connector 1, and the plug-in face of which touches the counterpart plug-in connector 4 which is orientated axially with respect thereto.

The plug-in connector 1, in this embodiment configured as a round plug-in connector, has a locking means 3 which is provided on the plug-in face of the plug-in connector housing 2 as a screw sleeve. A thread 6 is provided on the inside of the locking means 3. The internal thread 6 is screwed onto a thread 8 on the counterpart plug-in connector 4 to mechanically lock the plug-in connector 1.

The thread 8 of the counterpart connector 4 is provided as an external thread on a sleeve 11 which forms the counterpart plug-in connector 4. In this embodiment, the counterpart plug-in connector 4 has a fastening flange 12 which is integrally formed on the sleeve 11. The fastening flange 12 is used for fastening the counterpart plug-in connector 4 to a housing, a wall or the like.

In the internal receiving chambers 13, 14 of the plug-in connector 1 and of the counterpart plug-in connector 4, contact means and insulating bodies of any desired type may be received. The more detailed configuration of the contact means and the arrangement thereof in the plug-in connector 1 are not discussed further here. A number of plug-in connectors, contact means and insulating bodies are known in the art. All of these may be used equivalently in the presently disclosed plug-in connector 1.

In addition, an axial seal 15 is provided on the plug-in face of the plug-in connector 1, and seals the receiving chambers 13, 14 of the plug-in connector 1, 4 against environmental influences.

According to the invention, the plug-in connector 1 has a protective element 5 which is provided on the outside of the plug-in connector housing 2. In this embodiment, the protective element 5 is fixed to the plug-in connector housing 2 via a groove and covers a transition region 9 between the plug-in connector housing 2 and the locking means 3.

A gap, which cannot be completely sealed, is formed in the transition region 9 as a result of the two components—the plug-in connector housing 2 and the locking means 3. As a result of the locking means 3 being contacted with a counterpart plug-in connector 4, this gap becomes even larger as a result of the locking force directed in the plugging direction.

The protective element 5, in this case configured as a ring, is configured in such a way that it is positioned on the locking means 3 over the entire circumference and exerts a constant compressive force thereon. This prevents dirt from penetrating into the transition region 9.

In a manner corresponding to the transition region 9 between the plug-in connector housing 2 and the locking means 3, a further transition region 10 is also present between the locking means 3 and the contacted counterpart plug-in connector 4.

In this specific embodiment, an additional protective element 7 is present, and covers the transition region 10 in a manner corresponding to the protective element 5. In this context, the protective element 7 is fixed to the locking means 3 and is positioned on the counterpart connector 4.

FIG. 2 is a non-sectional drawing of the plug-in connector 1 according to the invention along with a contacted counterpart plug-in connector 4. It can be seen that the protective elements 5, 7 cover the transition regions 9, 10 between the plug-in connector housing 2 and the locking means 3 and between the locking means 3 and the counterpart plug-in connector 4.

As a result of the surface-optimised contour of the plug-in connector, deposition of grim and dirt is reduced by comparison with known plug-in connectors.

The invention claimed is:

1. Plug-in connector (1) comprising a plug-in connector housing (2) and a locking means (3) for mechanically connecting the plug-in connector housing to a counterpart plug-in connector (4), the locking means (3) being externally accessible on the plug-in connector housing (2), at least one protective element (5) being provided on the outside of the plug-in connector housing (2), and the protective element (5) covering a transition region (9) between the plug-in connector housing (2) and the locking means (3)

characterised in that a second protective element (7) is provided, said second protective element (7) being arranged on the front edge on the locking means (3) as seen in the plug-in direction and covering a transition region (10) between the locking means (3) and a contacted counterpart plug-in connector (4), wherein the second protective element (7) is an element separate from the protected element (5).

2. Plug-in connector (1) according to claim 1, characterised in that the second protective element (7) is fixed to the locking means (3) and in touching contact with a contacted counterpart plug-in connector (4), or the second protective element (7) is fixed to a contacted counterpart plug-in connector (4) and in touching contact with the locking means (3).

3. Plug-in connector (1) according to claim 1, characterised in that the second protective element (7) is in sealing touching contact with the locking means (3) and a contacted counterpart plug-in connector (4) over the entire plug-in connector circumference without gaps.

4. Plug-in connector (1) according to claim 1, characterised in that the protective element (5) is fixed to the plug-in connector housing (2) and in touching contact with the locking means (3), or the protective element (5) is fixed to the locking means (3) and in touching contact with the plug-in connector housing (2).

5. Plug-in connector (1) according to claim 1, characterised in that the locking means (3) is arranged rotatably on the plug-in face of the plug-in connector housing (2), the locking means (3) comprising a thread (6) for screwing to the counterpart plug-in connector (4).

6. Plug-in connector (1) according to claim 1, characterised in that the locking means (3) is arranged axially displaceably on the plug-in face of the plug-in connector housing (2), the locking means (3) being formed as a sliding sleeve and comprising latch means for latching to the counterpart plug-in connector (4).

7. Plug-in connector (1) according to claim 1, characterised in that the plug-in connector housing (2) and the locking means (3) are formed substantially as a hollow cylinder.

8. Plug-in connector (1) according to claim 1, characterised in that the protective element (5) is in sealing touching contact with the plug-in connector housing (2) and the locking means (3) over the entire plug-in connector circumference without gaps.

9. Plug-in connector (1) according to claim 1, characterised in that the external contour of the plug-in connector (1) is made completely smooth-edged.

10. Plug-in connector (1) according to claim 1, characterised in that said protective element (5) and said second protective element (7) comprise a resilient material.

11. Plug-in connector (1) according to claim 10, characterised in that the resilient elements (5, 7) consist of a plastics material.

12. Plug-in connector (1) according to claim 1, characterised in that the protective elements (5, 7) are integrally formed on the plug-in connector housing (2) or the locking means (3) in a single piece.

* * * * *